United States Patent [19]

Albinson et al.

[11] Patent Number: 4,554,065

[45] Date of Patent: Nov. 19, 1985

[54] ISOMERIZATION PROCESS TO PRODUCE LOW POUR POINT DISTILLATE FUELS AND LUBRICATING OIL STOCKS

[75] Inventors: Kenneth R. Albinson, Audubon; Jonathan E. Child, Sewell, both of N.J.

[73] Assignee: Mobil Oil Corporation, New York, N.Y.

[21] Appl. No.: 606,499

[22] Filed: May 3, 1984

[51] Int. Cl.[4] ..... C10G 65/10; C10G 65/12

[52] U.S. Cl. ..... 208/59; 208/89; 585/736; 585/739

[58] Field of Search ..... 208/59, 89, 111; 585/736, 739

[56] References Cited

U.S. PATENT DOCUMENTS 4,325,808 4/1982 Kim et al. ..... 208/65

4,419,220 12/1983 La Pierre et al. ..... 208/111

*Primary Examiner*—D. E. Gantz

*Assistant Examiner*—O. Chaudhuri

*Attorney, Agent, or Firm*—Alexander J. McKillop; Michael G. Gilman; Marina V. Schneller

[57] ABSTRACT

A process for dewaxing a hydrocarbon feedstock with a relatively high pour point and containing normal and slightly branched paraffins by subjecting said feed to catalytic dewaxing over a noble metal promoted zeolite beta catalyst followed by dewaxing with a base metal promoted zeolite beta catalyst. The feed may be hydrotreated before dewaxing.

20 Claims, 1 Drawing Figure

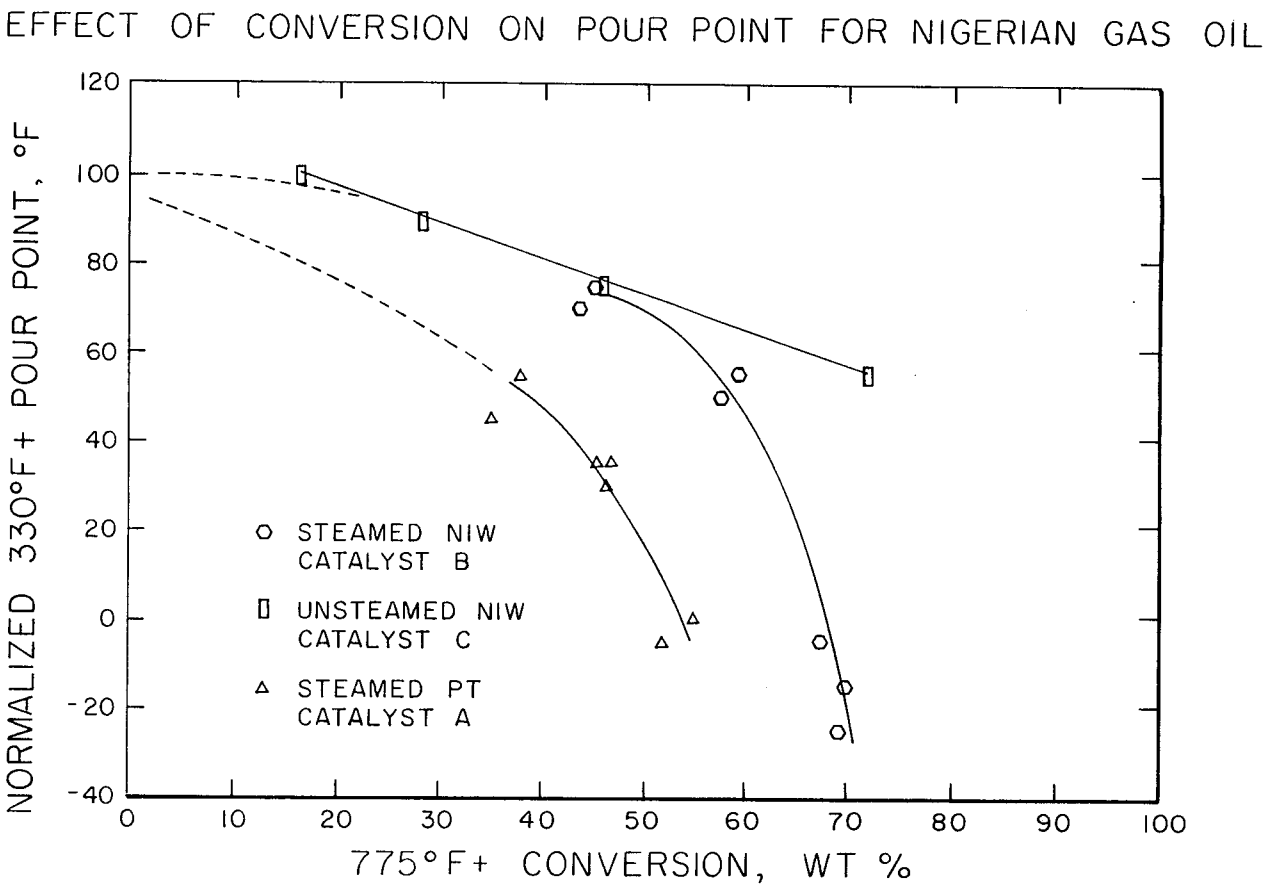
EFFECT OF CONVERSION ON POUR POINT FOR NIGERIAN GAS OIL
NORMALIZED 330°F+ POUR POINT, °F
120
100
80
60
40
20
0
-20
-40
775°F+ CONVERSION, WT %
0
10
20
30
40
50
60
70
80
90
100
STEAMED NIW CATALYST B
UNSTEAMED NIW CATALYST C
STEAMED PT CATALYST A

ISOMERIZATION PROCESS TO PRODUCE LOW POUR POINT DISTILLATE FUELS AND LUBRICATING OIL STOCKS

FIELD OF THE INVENTION

This invention relates to a process for dewaxing hydrocarbon oils.

PRIOR ART

Processes for dewaxing petroleum distillates have been known for a long time. Dewaxing is, as is well known, required when highly paraffinic oils are to be used in products which need to remain mobile at low temperatures e.g. lubricating oils, heating oils, jet fuels. The higher molecular weight straight chain normal and slightly branched paraffins which are present in oils of this kind are waxes which are the cause of high pour points in the oils and if adequately low pour points are to be obtained, these waxes must be wholly or partly removed. In the past, various solvent removal techniques were used e.g. propane dewaxing, MEK dewaxing, but the decrease in demand for petroleum waxes as such, together with the increased demand for gasoline and distillate fuels, has made it desirable to find processes which not only remove the waxy components but which also convert these components into other materials of higher value. Catalytic dewaxing processes achieve this end by selectively cracking the longer chain n-paraffins, to produce lower molecular weight products which may be removed by distillation. Processes of this kind are described, for example, in The Oil and Gas Journal, Jan. 6, 1975, pages 69 to 73 and U.S. Pat. No. 3,668,113.

It is also known to produce a high quality lube base stock oil by subjecting a waxy crude oil fraction to solvent refining, followed by catalytic dewaxing over ZSM-5, with subsequent hydrotreating of the lube base stock, as taught in U.S. Pat. No. 4,181,598, the entire contents of which is incorporated herein by reference.

In order to obtain the desired selectivity, the catalyst has usually been a zeolite having a pore size which admits the straight chain n-paraffins either alone or with only slightly branched chain paraffins, but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282 and 4,247,388. A dewaxing process employing synthetic offretite is described in U.S. Pat. No. 4,259,174. A hydrocracking process employing zeolite beta as the acidic component is described in U.S. Pat. No. 3,923,641.

Since dewaxing processes of this kind function by means of cracking reactions, a number of useful products become degraded to lower molecular weight materials. For example, olefins and naphthenes may be cracked down to butane, propane, ethane and methane and so may the lighter n-paraffins which do not, in any event, contribute to the waxy nature of the oil. Because these lighter products are generally of lower value than the higher molecular weight materials, it would obviously be desirable to avoid or to limit the degree of cracking which takes place during a catalytic dewaxing process, but to this problem there has as yet been no solution.

Another unit process frequently encountered in petroleum refining is isomerization. In this process, as conventionally operated, low molecular weight $C_4$ to $C_6$ n-paraffins are converted to iso-paraffins in the presence of an acidic catalyst such as aluminum chloride or an acidic zeolite as described in G.B. Pat. No. 1,210,335. Isomerization processes for pentane and hexane which operate in the presence of hydrogen have also been proposed but since these processes operate at relatively high temperatures and pressures, the isomerization is accompanied by extensive cracking induced by the acidic catalyst, so that, once more, a substantial proportion of useful products is degraded to less valuable lighter fractions.

It is also known that the catalytic activity of some dewaxing processes can be improved by removing impurities from the feed.

U.S. Pat. No. 4,358,362, the entire contents of which is incorporated herein by reference, teaches enhancing catalytic activity of a dewaxing process by subjecting the feed to the dewaxing process to treatment with a zeolite sorbent. It was thought that the use of a zeolite sorbent would adsorb more of the zeolite's specific poisons present in the feed than would a clay pretreatment of the feed.

It is also known to produce lubricating oil of improved properties of hydrotreating the lubricating oil base stock in the presence of ZSM-39 containing Co—Mo, as shown in U.S. Pat. No. 4,395,327, the entire contents of which is incorporated herein by reference.

U.S. Pat. No. 4,419,220, the entire contents of which is incorporated herein by reference, discloses catalytic dewaxing of distillate fuel oils and gas oils over a zeolite beta catalyst. Preferably the catalyst has a silica to alumina ratio over 100:1, and preferably contains a hydrogenation/dehydrogenation component, preferably a noble metal, e.g., platinum or palladium. Preferably the oil was subjected to hydrotreating, to remove sulfur and nitrogen compounds, prior to contacting the zeolite beta dewaxing catalyst.

Although the process disclosed in this U.S. patent taught a very good way to improve the pour point of distillate fuels and lubricating oil stocks, the use of noble metal promoters is expensive.

We attempted to develop a catalyst which could achieve the results of the noble metal promoted zeolite beta catalyst, without the cost of the noble metals. We were unable to obtain a base metal zeolite beta based catalyst that could entirely replace a Pt-beta dewaxing catalyst, but discovered that it was possible to replace a portion of the Pt-beta catalyst with a base metal-beta catalyst. Use of a mixed catalyst system, a noble metal promoted beta catalyst and a base metal promoted beta catalyst, will give results roughly equivalent to the noble metal-beta catalyst, with reduced catalyst cost.

SUMMARY OF THE INVENTION

The present invention provides a process for dewaxing a hydrocarbon feedstock with a relatively high pour point and containing paraffins selected from the group of normal paraffins and slightly branched paraffins which comprises subjecting said feedstock to catalytic dewaxing at catalytic dewaxing conditions by passing said feedstock, along with hydrogen, over a dewaxing catalyst comprising zeolite beta having a noble metal hydrogenation/dehydrogenation component to produce a partially dewaxed product and subjecting said partially dewaxed product to catalytic dewaxing at catalytic dewaxing conditions by passing said partially dewaxed product over catalyst comprising zeolite beta having a base metal hydrogenation/dehydrogenation component to recover a substantially dewaxed product as a product of the process.

In another embodiment the present invention provides a process for dewaxing a hydrocarbon feedstock with a relatively high pour point and containing aromatics and at least 10 weight percent waxy paraffins selected from the group of normal paraffins and slightly branched paraffins and sulfur and nitrogen compounds which comprises (a) subjecting said oil to hydrotreating in a hydrotreating zone containing a conventional hydrotreating catalyst operated at hydrotreating conditions including a temperature of 250° to 450° C., a hydrogen partial pressure of atmospheric to 15,000 kPa, and a liquid hourly space velocity of 0.1 to 10, to remove at least a portion of said sulfur and nitrogen compounds; (b) subjecting said feedstocks to catalytic dewaxing at catalytic dewaxing conditions by passing said feedstock, along with hydrogen, over a dewaxing catalyst comprising zeolite beta having a noble metal hydrogenation/dehydrogenation component to produce a partially dewaxed product and (c) subjecting said partially dewaxed product to catalytic dewaxing at catalytic dewaxing conditions by passing said partially dewaxed product over catalyst comprising zeolite beta having a base metal hydrogenation/dehydrogenation component to recover a substantially dewaxed product as a product of the process.

In a more limited embodiment the present invention provides a process for dewaxing a hydrocarbon feedstock with a relatively high pour point and containing at least 10 weight percent waxy paraffins selected from the group of normal paraffins and slightly branched paraffins and sulfur and nitrogen compounds which comprises subjecting said oil to hydrotreating in a hydrotreating zone containing a conventional hydrotreating catalyst operated at hydrotreating conditions including a temperature of 250° to 450° C., a hydrogen partial pressure of atmospheric to 15,000 kPa, and a liquid hourly space velocity of 0.1 to 10, to remove at least a portion of said sulfur and nitrogen compounds; subjecting said hydrotreated oil to catalytic dewaxing over a noble metal promoted zeolite beta catalyst followed by catalytic dewaxing over a base metal promoted zeolite beta dewaxing catalyst, wherein said noble metal promoted beta catalyst comprises 10 to 90 wt % of said dewaxing catalyst and said base metal promoted beta catalyst comprises 90 to 10 wt % of said dewaxing catalyst and wherein there is no separation of products or byproducts intermediate said noble metal dewaxing and said base metal dewaxing, and wherein said noble metal catalyst contains 0.1 to 2 wt % platinum or palladium and said base metal catalyst contains 1 to 5 wt % nickel and 2 to 20 wt % tungsten, on an elemental metal basis.

BRIEF DESCRIPTION OF THE DRAWING

The single FIGURE graphically shows the effects of conversion on pour point, using noble and base metal promoted zeolite beta catalysts.

DESCRIPTION OF PREFERRED EMBODIMENTS

Feedstock

The present process may be used to dewax a variety of feedstocks ranging from relatively light distillate fractions up to high boiling stocks such as whole crude petroleum, reduced crudes, vacuum tower residua, cycle oils, FCC tower bottoms, gas oils, vacuum gas oils, deasphalted residua and other heavy oils. The feedstock will normally be a $C_{10}$+feedstock since lighter oils will usually be free of significant quantities of waxy components. However, the process is particularly useful with waxy distillate stocks such as light and heavy gas oils, kerosenes, jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydrocracked stocks are a convenient source of stocks of this kind and also of other distillate fractions since they normally contain significant amounts of waxy n-paraffins which have been produced by the removal of polycyclic aromatics. The feedstock for the present process will normally be a $C_{10}$+feedstock containing paraffins, olefins, naphthenes, aromatics and heterocyclic compounds and with a substantial proportion of higher molecular weight n-paraffins and slightly branched paraffins which contribute to the waxy nature of the feedstock. During the processing, the n-paraffins become isomerized to iso-paraffins and the slightly branched paraffins undergo isomerization to more highly branched aliphatics. At the same time, a measure of cracking does take place so that not only is the pour point reduced by reason of the isomerization of n-paraffins to the less waxy branched chain iso-paraffins but, in addition, the heavy ends undergo some cracking or hydrocracking to form liquid range materials which contribute to a low viscosity product. The degree of cracking which occurs is, however, limited so that the gas yield is reduced, thereby preserving the economic value of the feedstock.

It is a particular advantage of the present process that the isomerization proceeds readily, even in the presence of significant proportions of aromatics in the feedstock and for this reason, feedstocks containing aromatics e.g. 10 percent or more aromatics, may be successfully dewaxed. The aromatic content of the feedstock will depend, of course, upon the nature of the crude employed and upon any preceding processing steps such as hydrocracking which may have acted to alter the original proportion of aromatics in the oil. The aromatic content may sometimes exceed 50 percent by weight of the feedstock and more usually will be not more than 10 to 50 percent by weight, with the remainder consisting of paraffins, olefins, naphthenes and heterocyclics. The paraffin content (normal and iso-paraffins) will generally be at least 10 percent by weight, more usually at least 20 percent by weight. Certain feedstocks such as jet fuel stocks may contain as little as 5 percent paraffins.

The feedstock, prior to hydrotreating, contains up to 30,000 wt ppm sulfur, and up to 20,000 wt ppm nitrogen, and at least 5, but usually in excess of 10 wt % waxy components selected from the group of normal paraffins and slightly branched chain paraffins.

It is preferred, but not essential, to subject the feed to conventional hydrotreating before contacting the feed with our dual catalyst system. The advantage of subjecting the feed to conventional hydrotreating prior to dewaxing is that better results are achieved, i.e., lower pour points, etc., when the oil is subjected to hydrotreating prior to dewaxing. More details on the advantages of hydrotreating prior to dewaxing are disclosed in U.S. Pat. No. 4,419,220, which has been incorporated herein by reference.

Hydrotreating Catalyst and Process

Any conventional hydrotreating catalyst and processing conditions may be used.

Preferably the hydrotreating process uses a catalyst containing a hydrogenation component on a support, preferably a non-acidic support, e.g., Co—Mo or Ni—Mo on alumina.

The hydrotreater usually operates at temperatures of 200° to 450° C., and preferably at temperatures of 250° to 400° C.

The hydrotreating catalyst may be disposed as a fixed, fluidized, or moving bed of catalyst, though downflow, fixed bed operation is preferred because of its simplicity. When the hydrotreating catalyst is disposed as a fixed bed of catalyst, the liquid hourly space velocity, or volume per hour of liquid feed measured at 20° C. per volume of catalyst will usually be in the range of about 0.1 to 10, and preferably about 1 to 5. In general higher space velocities or throughputs require higher temperature operation in the reactor to produce the same amount of hydrotreating.

The hydrotreating operation is enhanced by the presence of hydrogen, so typically hydrogen partial pressures of atmospheric to 15,000 kPa are employed, and preferably 1000 to 10,000 kPa. Hydrogen can be added to the feed on a once through basis, with the hydrotreater effluent being passed directly to the wax isomerization zone.

Alternatively, and preferably, the hydrotreater effluent is cooled, and the hydrogen rich gas phase recycled to the hydrotreater. Cooling of hydrotreater effluent, and separation into vapor and liquid phases promotes removal of some of the nitrogen and sulfur impurities which would otherwise be passed into the catalytic isomerization zone.

Other suitable hydrogenation components include one or more of the metals, or compounds thereof, selected from Groups II, III, IV, V, VIB, VIIB, VIII and mixtures thereof of the Periodic Table of the Elements. Preferred metals include molybdenum, tungsten, vanadium, chromium, cobalt, titanium, iron, nickel and mixtures thereof.

Usually the hydrotreating metal component will be present on a support in an amount equal to 0.1 to 30 weight percent of the support, with operation with 5 to 25 weight percent hydrogenation/dehydrogenation metal, on an elemental basis, giving good results. Sometimes even higher metal loadings, in excess of 25 weight percent, are used, but this is not usual.

The hydrogenation/dehydrogenation components are usually disposed on a support, preferably an amorphous support such as silica, alumina, silica-alumina, etc. Any other conventional support material may also be used. It is also possible to include on the support an acid acting component, such as an acid exchanged clay or a zeolite.

Preferably the support does not have much acidity, it is preferred to primarily conduct hydrotreating in the hydrotreating zone and minimize cracking or other reactions therein.

Zeolite Beta

The isomerization catalyst used in the process comprises zeolite beta, preferably with a hydrogenation/dehydrogenation component. Zeolite beta is a known zeolite which is described in U.S. Pat. Nos. 3,308,069 and Re. 28,341, the entire contents of which are incorporated herein by reference. The composition of zeolite beta in its as synthesized form is as follows; on an anhydrous basis:

$$[XNa(1.0\pm0.1-X)TEA]AlO_2\times YSiO_2.$$

where X is less than 1, preferably less than 0.75; TEA represents the tetraethylammonium ion; Y is greater than 5 but less than 100. In the as-synthesized form, water of hydration may also be present in ranging amounts.

The sodium is derived from the synthesis mixture used to prepare the zeolite. This synthesis mixture contains a mixture of the oxides (or of materials whose chemical compositions can be completely represented as mixtures of the oxides) $Na_2O$, $Al_2O_3$, $[(C_2H_5)_4N]_2O$, $SiO_2$ and $H_2O$. The mixture is held at a temperature of about 75° C. to 200° C. until crystallization occurs. The composition of the reaction mixture expressed in terms of mole ratios, preferably falls within the following ranges:

$SiO_2/Al_2O_3$—10 to 200
$Na_2O$/tetraethylammonium hydroxide (TEAOH-)—0.0 to 0.1
TEAOH/$SiO_2$—0.1 to 1.0
$H_2O$/TEAOH—20 to 75

The product which crystallizes from the hot reaction mixture is separated, suitably by centrifuging or filtration, washed with water and dried. The material so obtained may be calcined by heating in air on an inert atmosphere at a temperature usually within the range 200° C. to 900° C. or higher. This calcination degrades the tetraethylammonium ions to hydrogen ions and removes the water so that N in the formula above becomes zero or substantially so. The formula of the zeolite is then:

$$[XNa(1.0\pm0.1-X)H].AlO_2.YSiO_2$$

where X and Y have the values ascribed to them above. The degree of hydration is here assumed to be zero, following the calcination.

If this H-form zeolite is subjected to base exchange, the sodium may be replaced by another cation to give a zeolite of the formula (anhydrous basis):

$$[(x/n)M(1\pm0.1-X)H].AlO_2.YSiO_2$$

where X, Y have the values ascribed to them above and n is the valence of the metal M which may be any metal but is preferably a metal of Groups IA, IIA or IIIA of the Periodic Table or a transition metal (the Periodic Table referred to in this specification is the table approved by IUPAC, and the U.S. National Bureau of Standards shown, for example, in the table of Fisher Scientific Company, Catalog No. 5-702-10).

The as-synthesized sodium form of the zeolite may be subjected to base exchange directly without intermediate calcination to give a material of the formula (anhydrous basis):

$$[(x/n)M(1\pm0.1-X)TEA]AlO_2.YSiO_2.$$

where X, Y, n and M are as described above. This form of the zeolite may then be converted partly to the hydrogen form by calcination e.g. at 200° C. to 900° C. or higher. The completely hydrogen form may be made by ammonium exchange followed by calcination in air or an inert atmosphere such as nitrogen. Base exchange may be carried out in the manner disclosed in U.S. Pat. Nos. 3,308,069 and Re. 28,341.

Because tetraethylammonium hydroxide is used in its preparation, zeolite beta may contain occluded tetraethylammonium ions (e.g., as the hydroxide or silicate) within its pores in addition to that required by electroneutrality and indicated in the calculated formulae given in this specification. The formulae, of course, are calculated using one equivalent of cation per Al atom in tetrahedral coordination in the crystal lattice.

Zeolite beta, in addition to possessing a composition as defined above, may also be characterized by its X-ray diffraction data which are set out in U.S. Pat. Nos. 3,308,069 and Re. 28,341. The significant d values (Angstroms, radiation: K alpha doublet of copper, Geiger counter spectrometer) are as shown in Table 1 below:

TABLE 1

| d Values of Reflections in Zeolite Beta |
|---|
| 11.40+0.2 |
| 7.40+0.2 |
| 6.70+0.2 |
| 4.25+0.1 |
| 3.97+0.1 |
| 3.00+0.1 |
| 2.20+0.1 |

The preferred forms of zeolite beta for use in the present process are the high silica forms, having a silica:alumina ratio of at least 30:1. It has been found, in fact, that zeolite beta may be prepared with silica:alumina ratios above the 100:1 maximum specified in U.S. Pat. Nos. 3,308,069 and Re. 28,341 and these forms of the zeolite provide the best performance in the present process. Ratios of at least 30:1 and preferably at least 100:1 or even higher e.g. 250:1, 500:1 may be used in order to maximize the isomerization reactions at the expense of the cracking reactions.

The silica:alumina ratios referred to in this specification are the structural or framework ratios, that is, the ratio of the $SiO_4$ to the $AlO_4$ tetrahedra which together constitute the structure of which the zeolite is composed. It should be understood that this ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by the $TGA/NH_3$ adsorption method, a low ammonia titration may be obtained if cationic aluminum prevents exchange of the ammonium ions onto the acidic sites. These disparities are particularly troublesome when certain treatments such as the dealuminization method described below which result in the presence of ionic aluminum free of the zeolite structure are employed. Due care should therefore be taken to ensure that the framework silica:alumina ratio is correctly determined.

The silica:alumina ratio of the zeolite may be determined by the nature of the starting materials used in its preparation and their quantities relative one to another. Some variation in the ratio may therefore be obtained by changing the relative concentration of the silica precursor relative to the alumina precursor but definite limits in the maximum obtainable silica:alumina ratio of the zeolite may be observed. For zeolite beta this limit is about 100:1 and for ratios above this value, other methods are usually necessary for preparing the desired high silica zeolite. One such method comprises dealumination by extraction with acid and this method is disclosed in detail in U.S. patent application Ser. No. 379,399, filed May 13, 1982, by R. B. LaPierre and S. S. Wong, entitled "High Silica Zeolite Beta" (Mobile Oil Corporation Patent Information No. OR 81-P-40), and reference is made to this application for details of the method.

Briefly, the method comprises contacting the zeolite with an acid, preferably a mineral acid such as hydrochloric acid. The dealuminization proceeds readily at ambient and mildly elevated temperatures and occurs with minimal losses in crystallinity, to form high silica forms of zeolite beta with silica:alumina ratios of at least 100:1, with ratios of 200:1 or even higher being readily attainable.

The zeolite is conveniently used in the hydrogen form for the dealuminization process although other cationic forms may also be employed, for example, the sodium form. If these other forms are used, sufficient acid should be employed to allow for the replacement by protons of the original cations in the zeolite. The amount of zeolite in the zeolite/acid mixture should generally be from 5 to 60 percent by weight.

The acid may be a mineral acid, i.e., an inorganic acid or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidodisulfonic acid, nitrosulfonic acid, chlorosulfuric acid, pyrosulfuric acid, and nitrous acid. Representative organic acids which may be used include formic acid, trichloroacetic acid, and trifluoroacetic acid.

The concentration of added acid should be such as not to lower the pH of the reaction mixture to an undesirably low level which could affect the crystallinity of the zeolite undergoing treatment. The acidity which the zeolite can tolerate will depend, at least in part, upon the silica/alumina ratio of the starting material. Generally, it has been found that zeolite beta can withstand concentrated acid without undue loss in crystallinity but as a general guide, the acid will be from 0.1N to 4.0N, usually 1 to 2N. These values hold good regardless of the silica:alumina ratio of the zeolite beta starting material. Stronger acids tend to effect a relatively greater degree of aluminum removal than weaker acids.

The dealuminization reaction proceeds readily at ambient temperatures but mildly elevated temperatures may be employed e.g. up to 100° C. The duration of the extraction will affect the silica:alumina ratio of the product since extraction is time dependent. However, because the zeolite becomes progressively more resistant to loss of crystallinity as the silica:alumina ratio increases i.e. it becomes more stable as the aluminum is removed, higher temperatures and more concentrated acids may be used towards the end of the treatment than at the beginning without the attendant risk of losing crystallinity.

After the extraction treatment, the product is water washed free of impurities, preferably with distilled water, until the effluent wash water has a pH within the approximate range of 5 to 8.

The crystalline dealuminized products obtained by the method of this invention have substantially the same cyrstallographic structure as that of the starting aluminosilicate zeolite but with increased silica:alumina ratios. The formula of the dealuminized zeolite beta will therefore be, on an anhydrous basis:

$$[(x/n)M(1\pm0.1-X)H]AlO_2.YSiO_2$$

where X is less than 1, preferably less than 0.75, Y is at least 100, preferably at least 150 and M is a metal, preferably a transition metal or a metal of Groups IA, 2A or 3A, or a mixture of metals. The silica:alumina ratio, Y, will generally be in the range of 100:1 to 500:1, more usually 150:1 to 300:1, e.g. 200:1 or more. The X-ray diffraction pattern of the dealuminized zeolite will be substantially the same as that of the original zeolite, as set out in Table 1 above. Water of hydration may also be present in varying amounts.

If desired, the zeolite may be steamed prior to acid extraction so as to increase the silica:alumina ratio and render the zeolite more stable to the acid. The steaming may also serve to increase the ease with which the aluminum is removed and to promote the retention of crystallinity during the extraction procedure.

Noble Metal Hydrogenation/Dehydrogenation Component

The zeolite beta is associated with a hydrogenation-dehydrogenation component, regardless of whether hydrogen is added during the isomerization process since the isomerization is believed to proceed by dehydrogenation through an olefinic intermediate which is then hydrogenated to the isomerized product, both these steps being catalyzed by the hydrogenation component. The hydrogenation component is preferably a noble metal such as platinum, palladium, or another member of the platinum group such as rhodium. Combinations of noble metals such as platinum-rhenium, platinum-palladium, platinum-iridium or platinium-iridium-rhenium together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten. Platinum and palladium are preferred noble metal products.

When noble metals are added, they will usually comprise 0.01 to 10 wt% of the finished catalyst, on an elemental metal basis. Because of the high activity and cost of the noble metals, operation with 0.1 to 5 wt % noble metal is preferred, with 0.6 to 1.0 wt % Pt or Pd giving very good results.

Base Metal Hydrogenation/Dehydrogenation Component

A portion of the noble metal promoted zeolite beta catalyst can be replaced with a non-noble metal promoted zeolite beta catalyst. It is believed that some replacement of noble with non-noble metal promoted catalyst can be made when any of the conventional base metal hydrogenation/dehydrogenation promoters are added to the zeolite beta catalyst. Suitable non-noble metals can be taken from Groups VIA and VIIIA. Preferred non-noble metal hydrogenation/dehydrogenation components include cobalt, nickel, vanadium, tungsten, titanium, and molybdenum and pairs of metals, such as Co-Mo, Ni-Mo, and Ni-W with Ni-W being especially preferred.

Operation with 1–25 weight percent base metal promoter is preferred. A catalyst with about 1 to 5 wt % Ni, and 2 to 20 wt % W, preferably with 4 wt % Ni, and 10 wt % W, gives very good results.

Catalyst Preparation

The metal may be incorporated into the catalyst by any suitable method such as impregnation or exchange onto the zeolite. The metal may be incorported in the form of a cationic, anionic or neutral complex such as $Pt(NH_3)_4{}^{2+}$ and cationic complexes of this type will be found convenient for exchanging metals onto the zeolite. Anionic complexes such as the vanadate or metatungstate ions are useful for impregnating metals into the zeolites.

The hydrogenation/dehydrogenation components may be subjected to a pre-sulfiding treatment with a sulfur-containing gas such as hydrogen sulfide in order to convert the oxide forms of the metal to the corresponding sulfides. Sulfiding may be gas phase, liquid phase, or spiked liquid phase.

It may be desirable to incorporate the catalyst in another material resistant to the temperature and other conditions employed in the process. Such matrix materials include synthetic or natural substances as well as inorganic materials such as clay, silica and/or metal oxides. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calcination, acid treatment or chemical modification.

The catalyst may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia-zirconia. The matrix may be in the form of a cogel with the zeolite. The relative proportions of zeolite component and inorganic oxide gel matrix may vary widely with the zeolite content ranging from between 1 to 99, more usually 5 to 80, percent by weight of the composite. The matrix may itself possess catalytic properties, generally of an acidic nature.

Relative Amounts of Noble/Base Promoted Beta Catalyst

The ratio of noble to base metal zeolite beta catalyst can vary broadly. If almost all noble metal catalyst is used, there will not be much savings attributed to the use of base metal promoted beta catalyst. At the other extreme, if mostly base metal zeolite beta catalyst is used, there would be some loss in product quality, e.g., the distillate fuel or waxed stock produced will have a higher pour point.

Preferably the noble metal beta catalyst comprises 10 to 90 wt. % of the dewaxing catalyst, while the base metal promoted beta catalyst comprises 90 to 10 weight % of the dewaxing catalyst.

Very good results are achieved when the noble metal promoted beta catalyst comprises 20–65% of the beta catalyst used, while base metal catalyst comprises the remainder.

In its simplest embodiment, the two different zeolite beta catalysts are simply disposed as to layers within a fixed bed reactor. Alternatively, the two different catalysts may be located in separate reactors. In some circumstances, e.g., making maximum use of existing equipment that happens to be in a plant, it will be expedient to use a three reactor system, with the first reactor in series containing 100 percent of the noble metal beta, the middle reactor containing two separate layers of catalyst, and the third reactor in series containing only the base metal promoted beta catalyst.

Although fixed beds are preferred, because they are simple and relatively inexpensive, it is also possible to operate with one or more fluidized or moving beds of catalyst.

Isomerization Process Conditions

The feedstock is contacted with the zeolite in the presence or absence of added hydrogen at elevated temperature and pressure. The isomerization is preferably conducted in the presence of hydrogen both to reduce catalyst aging and to promote the steps in the isomerization reaction which are thought to proceed from unsaturated intermediates. Temperatures are normally from 250° C. to 500° C. (about 480° F. to 930° F.), preferably 400° C. to 450° C. (750° F. to 840° F.) but temperatures as low as 200° C. may be used for highly paraffinic feedstocks, especially pure paraffins. The use of lower temperatures tends to favor the isomerization reactions over the cracking reactions. Pressures may range from atmospheric up to 25,000 kPa (3,600 psig). Generally pressures are 1,000 to 15,000 kPa (144 to 2,160 psig), more usually in the range 2,000 to 10,000 kPa (288 to 1,435 psig). Space velocity (LHSV) is generally from 0.1 to 10 $hr^{-1}$ more usually 0.2 to 5 $hr^{-1}$. If additional hydrogen is present, the hydrogen:feedstock ratio is generally from 20 to 4,000 $n.l.l.^{-1}$ (113 to 22,470 SCF/bbl), preferably 200 to 2,000 $n.l.l.^{-1}$ (1,125 to 11,235 SCF/bbl).

The process may be conducted with the catalyst in a fixed, fluidized, or moving bed, as desired. A simple and therefore preferred configuration is a fixed-bed operation in which the feed passes down through a stationary fixed bed of catalyst. With such configuration, it is of considerable importance in order to obtain maximum benefits from this invention to initiate the reaction with fresh catalyst at a relatively low temperature such as 300° C. to 350° C. This temperature is, of course, raised as the catalyst ages, in order to maintain catalytic activity. In general, for lube oil base stocks the run is terminated at an end-of-run temperature of about 450° C., at which time the catalyst may be regenerated or replaced.

The present process proceeds mainly by isomerization of the n-paraffins to form branched chain products, with but a minor amount of cracking and the products will contain only a relatively small proportion of gas and light ends up to $C_5$. Because of this, there is less need for removing the light ends which could have an adverse effect on the flash and fire points of the product, as compared to processes using other catalysts. However, since some of these volatile materials will usually be present from cracking reactions, they may be removed by distillation.

It may be desirable to vary the reaction conditions depending both upon the paraffinic content of the feedstock and upon its boiling range, in order to maximize isomerization relative to other and less desired reactions.

A preliminary hydrotreating step to remove nitrogen and sulfur and to saturate aromatics to naphthenes without substantial boiling range conversion will usually improve catalyst performance and permit lower temperatures, higher space velocities, lower pressures or combinations of these conditions to be employed.

The invention is illustrated by the following examples, in which all percentages are by weight, unless the contrary is stated.

Prior Art Examples—Examples 1–10

EXAMPLE 1

This Example describes the preparation of high silica zeolite beta.

A sample of zeolite beta in its as synthesized form and having a silica:alumina ratio of 30:1 was calcined in flowing nitrogen at 500° C. for 4 hours, followed by air at the same temperature for 5 hours. The calcined zeolite was then refluxed with 2N hydrochloric acid at 95° C. for one hour to produce a dealuminized, high silica form of zeolite beta having a silica:alumina ratio of 280:1, an alpha value of 20 and a crystallinity of 80 percent relative to the original, assumed to be 100 percent crystalline. The significance of the alpha value and a method for determining it and described in U.S. Pat. No. 4,016,218 and J. Catalysts, Vol VI, 278–287 (1966), to which reference is made for these details.

For comparison purposes a high silica form of zeolite ZSM-20 was prepared by a combination of steam calcination and acid extraction steps (silica:alumina ratio 250:1, alpha value 10). Dealuminized mordenite with a silica:alumina ratio of 100:1 was prepared by acid extraction of dehydroxylated mordenite.

All the zeolites were exchanged to the ammonium form with 1N ammonium chloride solution at 90° C. reflux for an hour followed by the exchange with 1N magnesium chloride solution at 90° C. reflux for an hour. Platinum was introduced into the Beta and ZSM-20 zeolites by ion-exchange of the tetrammine complex at room temperature while palladium was used for the mordenite catalyst. The metal exchanged materials were thoroughly washed and oven dried followed by air calcination at 350° C. for 2 hours. The finished catalysts, which contain 0.6% Pt and 2% Pd by weight, were pelleted, crushed and sized to 30–40 mesh (Tyler) (approx. 0.35 to 0.5 mm) before use.

EXAMPLE 2

This example is a commercially available hydrotreating catalyst, a cobalt-moly on alumina hydrotreating catalyst.

EXAMPLE 3

This example illustrates the beneficial effect of hydrotreating the oil prior to catalytic isomerization.

Two cc of the metal exchanged zeolite beta catalyst were mixed with 2 cc of 30–40 (Tyler) mesh acid washed quartz chips ("Vycor"-trademark) and then loaded into a 10 mm ID stainless steel reactor. The catalyst was reduced in hydrogen at 450° C. for an hour at atmospheric pressure. Prior to the introduction of the liquid feed, the reactor was pressurized with hydrogen to the desired pressure.

The liquid feed used was an Arab light gas oil having the following analysis, by mass spectroscopy:

TABLE 2

| Mass Spectral Analysis of Raw Gas Oil | |
|---|---|
| Hydrocarbon Type | |
| | Aromatic Fraction (%) |
| Alkyl Benzenes | 7.88 |
| Diaromatics | 7.45 |
| Triaromatics | 0.75 |
| Tetraaromatics | 0.12 |
| Benzothiophenes | 2.02 |
| Dibenzothiphenes | 0.74 |
| Naphthenebenzenes | 3.65 |
| Dinaphthenebenzenes | 2.73 |
| | Non-Aromatic Fraction (%) |
| Paraffins | 52.0 |
| 1 Ring Naphthenes | 15.5 |
| 2 Ring Naphthenes | 5.4 |
| 3 Ring Naphthenes | 1.4 |
| 4 Ring Naphthenes | 0.5 |
| Monoaromatics | 0.2 |

For comparison, the raw gas oil was hydrotreated over the CO—MO on $Al_2O_3$ catalyst of Example 2 (HT-400) at 370° C., 2 LHSV, 3550 kPa in the presence of 712 n.l.l$^{-1}$ of hydrogen.

The properties of the raw and hydrotreated (HDT) gas oils are shown below in Table 3.

TABLE 3

| Properties of Arab Light Gas Oil | | |
|---|---|---|
| | Raw Oil | HDT Oil |
| Boiling Range, °C. | 215–380 | 215–380 |
| Sulfur, % | 1.08 | 0.006 |
| Nitrogen, ppm | 53 | 14 |
| Pour point, °C. | −10 | −10 |

The raw and HDT oils were dewaxed under the conditions shown below in Table 4 to give the products shown in the table. The liquid and gas products were collected at room temperature and atmospheric pressure and the combined gas and liquid recovery gave a material balance of over 95%.

TABLE 4

| Isomerization of Light Gas Oil Over Zeolite Catalyst | | |
|---|---|---|
| | Example 2 Raw Feed | Example 3 HDT Feed |
| Reaction Pressure, kPa | 6996 | 3550 |
| Temperature, °C. | 402 | 315 |
| LHSV | 1 | 1 |
| Products, percent: | | |
| $C_{1-4}$ | 2.3 | 1.8 |
| $C_5$–165° C. | 16.1 | 16.5 |
| 165° C.+ | 81.6 | 81.7 |
| Total Liquid Product, | | |
| Pour Point, °C. | −53 | −65 |
| 165° C.+, Pour Point, °C. | −42 | −54 |

The results in Table 4 show that low pour point kerosine products may be obtained in a yield of over 80 percent and with the production of only a small proportion of gas, although the selectivity for liquids was slightly lower with the raw oil.

EXAMPLES 4–7

These Examples demonstrate the superiority of zeolite beta for dewaxing, compared to other zeolites.

The procedure of Example 3 was repeated, using the hydrotreated (HDT) light gas oil as the feedstock and the three catalysts described in Example 1. The reaction conditions and product quantities and characteristics are shown in Table 5 below.

TABLE 5

| Isomerization of HDT Light Gas Oil | | | | |
|---|---|---|---|---|
| | Example No. | | | |
| | 4 (Pt/Beta) | 5 (Pt/ZSM-20) | 6 (Pt/ZSM-20) | 7 (Pd/Mordenite) |
| Reaction Pressure, kPa | 3550 | 5272 | 10443 | 3550 |
| Temperature, °C. | 315 | 370 | 350 | 315 |
| LHSV | 1 | 1 | 1 | 0.5 |
| Products, percent: | | | | |
| $C_{1-4}$ | 1.8 | 4.6 | 1.4 | 6.8 |
| $C_5$–165° C. | 16.5 | 24.8 | 17.0 | 53.3 |
| 165° C.+ | 81.7 | 70.6 | 81.6 | 39.9 |
| Total Liquid Product, Pour Point, °C. | −65 | −39 | −22 | −42 |

The above results show that at the same yield for 165° C.+ products, the ZSM-20 showed much lower selectivity for isomerization than the zeolite beta and that the mordenite catalyst was even worse.

EXAMPLES 8–10

These Examples illustrate the advantage of zeolite beta in comparison to zeolite ZSM-5.

The procedure of Example 3 was repeated, using the raw light gas oil as the feedstock. The catalyst used was the Pt/Beta (Example 8) or Ni/ZSM-5 containing about 1 percent nickel (Example 9). The results are shown in Table 6 below, including for comparison the results from a sequential catalytic dewaxing/hydrotreating process carried out over Zn/Pd/ZSM-5 (Example 10).

TABLE 6

| Isomerization of Raw Light Gas Oil | | | |
|---|---|---|---|
| | Example No. | | |
| | 8 (Pt/Beta) | 9 (Ni/ZSM-5) | 10 (Zn/Pd/ZSM-5) |
| Product Hydrotreating | No | No | Yes |
| Reaction Pressure, kPa | 6996 | 5272 | 6996 |
| Temperature, °C. | 402 | 368 | 385 |
| LHSV | 1 | 2 | 2 |
| Products, percent: | | | |
| $C_{1-4}$ | 2.3 | 8.6 | 15.9 |
| $C_5$–165° C. | 16.1 | 11.4 | 19.8 |
| 165° C.+ | 81.6 | 79.1 | 64.3 |
| Total Liquid Product, Pour Point, °C. | −53 | −34 | −54 |

The zeolite beta dewaxing gives a lower pour point product than ZSM-5 dewaxing when both are adjusted to give about the same yield of 165° C.+ product (Ex. 8 vs. Ex. 9). Alternatively, zeolite beta dewaxing gives more product at a constant pour point (Ex. 8 v. Ex. 10).

Discussion of Prior Art Examples

The significance of these prior art examples (1–10) is to establish the good performance of noble metal promoted zeolite beta dewaxing catalyst. The only drawback to such a process is the relatively high cost of the platinum promoter.

In a plant designed to process 20,000 barrels per day of gas oil feed, at a 1 LHSV, the reactor would contain 132.5 cubic meters of catalyst, or 70.2 metric tons of catalyst. If this catalyst contained 0.6 wt % Pt, the amount of platinum present would be 0.421 tons, equivalent to 13500 troy ozs. Although the price of platinum has fluctuated greatly, its price will usually be close to that of gold, so that there is a tremendous investment in noble metal promoter for such a dewaxing process.

EXAMPLE 11 (INVENTION)

Three metal promoted catalysts were prepared by the following method:

A mixture of Na-TEA zeolite beta and Kaiser SA alumina was prepared. The ratio of the two components was 65 weight percent zeolite beta/35 weight percent $Al_2O_3$. The zeolite beta was synthesized with a silica to alumina mole ratio of 40:1. Conventional techniques were used to form a 1/16th inch (0.16 cm) diameter extrudate. The extrudate was dried at 250° F. (121° C.).

The extrudate was then calcined for 3 hours at 1000° F. (538° C.) in a nitrogen stream flowing at the rate of three volumes of nitrogen at standard conditions per volume of extrudate per minute. Next the extrudate was calcined for another three hours, at the same temperature, in air, three volumes per minute of air per volume of catalyst. The catalyst was heated for calcining, at the rate of 5° F. per minute. Different catalyst preparation procedures were used from this point on to make the different catalysts.

CATALYST A—0.6 wt % Pt

Calcined extrudate was steamed for 72 hours at 1025° F. (552° C.) at one atmosphere pressure. The extrudate was steamed in an atmosphere of 90 mol % steam/10 mol % air, by passing five volumes, as measured at standard conditions, per minute of gas per volume of catalyst. The catalyst was heated at the rate of 5° F./min (2.8° C./min). The steamed catalyst was then exchanged twice, one hour each time, at room temperature in 5 ml/g circulating 1N $NH_4NO_3$. After exchange, the catalyst was washed in water, and dried at 250° F. (121° C.) overnight. This material was then exchanged for 5 hours at room temperature with $Pt(NH_3)_4(NO_3)_2$ in 5 ml/g water while stirring in a beaker. After exchange, the material was washed until the wash liquid was free of $Cl^-$. The catalyst was then dried at 270° F. (518° C.). The dried catalyst was then heated, at the rate of 2° F./min (1.1° C./min) and calcined in air for 3 hours at 660° F. (349° C.). Air flow during calcining was five volumes, measured at standard conditions per minute of air per volume of catalyst. The catalyst had an alpha activity of 49.

CATALYST B—4% Ni-10% W

Calcined extrudate was given the same streaming treatment, then ion exchanged with $NH_4NO_3$, washed, and dried at 250° F. (121° C.) overnight. This material was then calcined for two hours at 1000° F. (538° C.) in three volumes per minute of air measured at standard conditions per volume of catalyst.

After calcining, the material was cooled and subjected to impregnation, by the incipient wetness technique, with sufficient ammonium meta tungstate (AMT), and $Ni(NO_3)_2$ to add to the finished extrudate 4 wt % Ni and 10 wt % W, calculated on an elemental metal basis. The impregnated material was subsequently dried at 250° F. (121° C.), and then calcined two hours at 1000° F. (538° C.) in three volumes per minute of air, measured at standard conditions, per volume of catalyst. The calcined extrudate had an alpha activity of about 55. The steamed zeolite beta had a $SiO_2$:$Al_2O_3$ ratio of about 130:1.

CATALYST C—4% Ni-10% W (Unsteamed)

This material was made the same way as catalyst B, but omitting the steaming step. Thus, the calcined extrudate was subjected to two ion exchange treatments with $NH_4NO_3$, and then impregnated with AMT/$Ni(NO_3)_2$, dried and calcined. The zeolite beta in the extrudate had a $SiO_2$:$Al_2O_3$ ratio of about 40:1. The alpha activity would be considerably higher than that of catalysts A and B, but we did not test the alpha activity of the calcined extrudate.

The catalysts had the properties shown in Table 7.

TABLE 7

Pt and NiW ZSM-Beta/$Al_2O_3$ Catalyst Properties

| CATALYST I.D. | A | B | C |
|---|---|---|---|
| Zeolite Beta, Wt % | 65 | 65 | 65 |
| Alumina, Wt % | 35 | 35 | 35 |
| Platinum, Wt % | 0.63 | — | — |
| Nickel, Wt % | — | 4 | 4 |
| Tungsten, Wt % | — | 10 | 10 |
| Sodium, Wt % | 0.02 | 0.03 | 0.01 |
| Steamimg | Yes | Yes | No |
| Alpha on Catalyst | 49 | 55 | >50 |
| Extrudate Size, in | 1/16 | 1/16 | 1/16 |
| Density, g/cm$^3$ | | | |
| Packed | — | 0.64 | 0.66 |
| Particle | 0.773 | 1.034 | 0.964 |
| Real | 2.587 | 2.979 | 3.189 |
| Pore Volume, cc/g | 0.907 | 0.634 | 0.724 |
| Surface Area, m$^2$/g | 387 | 316 | 356 |
| Avg. Pore Diameter, A | 94 | 80 | 81 |
| Pore Volume Distribution | | | |
| P.V. % in pores of: | | | |
| 0-30 A Diameter | 20 | 26 | 22 |
| 30-50 | 7 | 5 | 5 |
| 50-80 | 9 | 10 | 8 |
| 80-100 | 5 | 5 | 4 |
| 100-150 | 7 | 9 | 6 |
| 150-200 | 4 | 6 | 4 |
| 200-300 | 8 | 19 | 9 |
| 300+ | 40 | 20 | 42 |

These catalysts were tested for the isomerization of raw Nigerian gas oil with the following properties:

TABLE 8

NIGERIAN GAS OIL PROPERTIES

| | |
|---|---|
| API Gravity | 22.9 |
| Hydrogen, Wt % | 12.65 |
| Sulfur, Wt % | 0.32 |
| Nitrogen, ppm | 748 |
| Basic Nitrogen, ppm | 469 |
| Pour Point, °F. | 95 |
| KV at 100° C. | 6.660 |
| CCR, Wt % | 0.04 |
| Composition, Wt % | |
| Paraffins | 20.8 |
| Naphthenes | 36.6 |
| Aromatics | 42.7 |
| Simulated Distillation, °F. | |
| IBP | 519 |
| 5 | 653 |
| 10 | 696 |
| 30 | 757 |
| 50 | 795 |
| 70 | 832 |
| 90 | 877 |
| 95 | 899 |
| EP | 954 |

EXAMPLE 12

This example compares the effectiveness of dewaxing with noble metal promoted beta catalyst compared to the base metal promoted beta catalyst of Example 11. Results are shown in Table 9.

TABLE 9

| Catalyst Performance | | |
|---|---|---|
| Catalyst I.D. | Pt-Beta A | NiW-Beta B |
| 775° F.+ Conversion, Wt % | 45 | 45 |
| 330° F.+ Pour Point, °F. | 35 | 75 |
| Temperature, °F. | 811 | 807 |
| Yields, Wt % Change | | |
| $C_1$–$C_4$ | 1.8 | 2.4 |
| $C_5$–330° F. | 5.7 | 5.7 |
| 330–650° F. | 26.7 | 26.1 |
| 650–775° F. | 32.3 | 32.3 |
| 775° F+ | 33.5 | 33.5 |

EXAMPLE 13

The catalysts A, B and C of Example 11 were subjected to comparison testing, and the results graphically shown in the attached figure. At low conversions, the slope of the pour point/conversion lines are quite different. At higher conversions, the slopes for catalyst A and B become similar.

Discussion

At low conversion levels the Pt-beta catalyst achieved a significant amount of conversion by hydroisomerization. At higher conversion levels, in the range of 40 to 50% conversion and higher, both Pt-beta and NiW-beta had similar conversion characteristics, i.e., the mix of reactions going on in achieving the higher conversion, probably predominantly hydrocracking with a limited amount of hydroisomerization, was about the same for both the noble and the non-noble metal promoted beta catalyst. Evidence of the similarity of reactions taking place, at the higher conversion levels can be seen by examining the figure. The slope of the lines drawn on the figure is a measure of the change in product pour point per unit change in conversion. The slope of the lines, for steamed NiW-beta and steamed Pt-beta becomes very similar at conversion levels exceeding around 40–50%. As similar catalytic reactions are occurring, at the higher conversion levels, NiW-beta catalyst can be substituted for Pt-beta catalyst with little or no penalty regards product yields, or product pour point.

The advantage of the process of the present invention can be most clearly seen when conversions in excess of 45–50% of the feed, by weight, are sought. If conversion is very low, from 10 to 30 wt % of feed, there is a significant penalty in using the base metal beta catalyst, rather than a Pt-beta catalyst, for dewaxing. For fairly high conversion levels, in excess of 50 wt %, the benefits of practicing the present invention, with little or no penalty, become apparent.

Some general guidelines can be given towards a relative amount of noble vs non-noble metal promoted beta catalyst. Each catalyst can be tested independently on the desired chargestock and the results graphically depicted, as in the attached figure. The noble metal promoted catalyst will have a relatively straight line at low conversions, up to about 30–40 wt % conversion, after which the relatively straight line becomes a curve.

Reaction zone conditions and the amount of noble metal promoted beta catalyst should be adjusted so that enough noble metal promoted beta catalyst is present to take advantage of the "straight line" conversion. This "straight line" conversion is believed to be achieved with significant amounts of hydroisomerization, promoted by the noble metal beta catalyst.

Enough base metal promoted beta catalyst can be added to achieve the desired final product pour point, or weight % conversion. Operation with two separate reactors, with provisions for temperature control in each reactor, gives some additional flexibility in that an increase in reactor temperature will simulate, to some extent, an increased volume of catalyst in that reactor. This also permits some flexibility to adjust reactor temperatures individually to compensate for different catalyst aging characteristics, or different responses to poisons that may be present in the feed.

Reactor temperatures can be controlled by heaters or heat exchangers, or by the direct injection of relatively hot, or cold, materials, e.g., hydrogen gas.

What is claimed is:

1. A process for dewaxing a hydrocarbon feedstock with a relatively high pour point and containing paraffins selected from the group of normal paraffins and slightly branched paraffins which comprises (a) subjecting said feedstock to catalytic dewaxing at catalytic dewaxing conditions including a temperature of 200° to 500° C., pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ by passing said feedstock, along with hydrogen, over a dewaxing catalyst comprising zeolite beta having a noble metal hydrogenation/dehydrogenation component to produce a partially dewaxed product and (b) subjecting said partially dewaxed product to catalytic dewaxing at catalytic dewaxing conditions including a temperature of 200° to 500° C., and pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ by passing said partially dewaxed product over catalyst comprising zeolite beta having a base metal hydrogenation/dehydrogenation component comprising at least one non-noble metal of Group VIA or VIIIA to recover a substantially dewaxed product as a product of the process.

2. Process of claim 1 in which the feedstock also includes aromatic components.

3. Process of claim 2 in which the proportion of aromatic components is from 10 to 60 weight percent of the feedstock.

4. Process of claim 1 in which the zeolite beta has a silica:alumina ratio over 30:1.

5. Process of claim 1 in which the zeolite beta has a silica:alumina ratio of at least 100:1.

6. Process of claim 1 in which the noble metal comprises 0.01 to 10 weight %, on an elemental basis, of said catalyst.

7. Process of claim 1 in which said base metal component comprises 0.1 to 25 weight %, on an elemental basis, of said catalyst.

8. Process of claim 1 in which said noble metal is platinum or palladium and said base metal is at least one of cobalt, nickel, molybdenum, tungsten and mixtures thereof.

9. Process of claim 1 in which said noble metal catalyst contains 0.6 weight % Pt, on an elemental basis, and said base metal catalyst contains 4 weight % nickel and 10 weight % tungsten, on an elemental metal basis.

10. Process of claim 1 in which said noble metal dewaxing catalyst comprises 10 to 90 weight % of the total amount of dewaxing catalyst and said base metal dewaxing catalyst comprises 90 to 10 weight % of the total amount of dewaxing catalyst.

11. A process for dewaxing a hydrocarbon feedstock oil with a relatively high pour point and containing aromatics and at least 10 weight percent waxy paraffins selected from the group of normal paraffins and slightly branched paraffins and sulfur and nitrogen compounds which comprises (a) subjecting said oil to hydrotreating in a hydrotreating zone containing a conventional hydrotreating catalyst operated at hydrotreating conditions including a temperature of 250° to 400° C., a hydrogen partial pressure of atmospheric to 15,000 kPa, and a liquid hourly space velocity of 0.1 to 10, to remove at least a portion of said sulfur and nitrogen compounds;

(b) subjecting said hydrotreated oil to catalytic dewaxing at catalytic dewaxing conditions including a temperature of 200° to 500° C., pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ by passing said hydrotreated oil, along with hydrogen, over a dewaxing catalyst comprising zeolite beta having a noble metal hydrogenation/dehydrogenation component to produce a partially dewaxed product and (c) subjecting said partially dewaxed product to catalytic dewaxing at catalytic dewaxing conditions including a temperature of 200° to 500° C., pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ by passing said partially dewaxed product over catalyst comprising zeolite beta having a base metal hydrogenation/dehydrogenation component comprising at least one non-noble metal of Group VIA or VIIIA to recover a substantially dewaxed product as a product of the process.

12. Process of claim 11 in which the proportion of aromatic components is from 10 to 60 weight percent of the feedstock.

13. Process of claim 11 in which the zeolite beta has a silica:alumina ratio over 30:1.

14. Process of claim 11 in which the zeolite beta has a silica:alumina ratio of at least 100:1.

15. Process of claim 11 in which the noble metal comprises 0.01 to 10 weight %, on an elemental basis, of said catalyst.

16. Process of claim 11 in which said base metal component comprises 0.1 to 25 weight %, on an elemental basis, of said catalyst.

17. Process of claim 11 in which said noble metal is platinum or palladium and said base metal is at least one of cobalt, nickel, molybdenum, tungsten and mixtures thereof.

18. Process of claim 11 in which said noble metal catalyst contains 0.6 weight % Pt, on an elemental basis, and said base metal catalyst contains 4 weight % nickel and 10 weight % tungsten, on an elemental metal basis.

19. Process of claim 11 in which said noble metal dewaxing catalyst comprises 10 to 90 weight % of the total amount of dewaxing catalyst and said base metal comprises 90 to 10 weight % of the total amount of dewaxing catalyst.

20. A process for dewaxing a hydrocarbon feedstock oil with a relatively high pour point and containing at least 10 weight percent waxy paraffins selected from the group of normal paraffins and slightly branched paraffins and sulfur and nitrogen compounds which comprises (a) subjecting said oil to hydrotreating in a hydrotreating zone containing a conventional hydrotreating catalyst operated at hydrotreating conditions including a temperature of 250° to 450° C., a hydrogen partial pressure of atmospheric to 15,000 kPa, and a liquid hourly space velocity of 0.1 to 10, to remove at least a portion of said sulfur and nitrogen compounds;

(b) subjecting said hydrotreated oil to catalytic dewaxing including a temperature of 200° to 500° C., pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ over a noble metal promoted zeolite beta catalyst followed by catalytic dewaxing including a temperature of 200° to 500° C., pressure from atmospheric to 25,000 kPa, the presence of 20 to 4,000 $nll^{-1}$ of hydrogen per volume of liquid feed, and a liquid hourly space velocity of 0.1 to 10 $hr.^{-1}$ over a base metal hydrogenation/dehydrogenation component promoted zeolite beta dewaxing catalyst, wherein said noble metal promoted beta catalyst comprises 10 to 90 wt % of said dewaxing catalyst and said base metal promoted beta catalyst comprises 90 to 10 wt % of said dewaxing catalyst and wherein there is no separation of products or byproducts intermediate said noble metal dewaxing and said base metal dewaxing, and wherein said noble metal catalyst contains 0.1 to 2 wt % platinum or palladium and said base metal catalyst contains 1 to 5 wt % nickel and 2 to 20 wt % tungsten, on an elemental metal basis.

* * * * *

UNITED STATES PATENT AND TRADEMARK OFFICE

CERTIFICATE OF CORRECTION

PATENT NO. : 4,554,065

DATED : November 19, 1985

INVENTOR(S) : Kenneth R. Albinson and Jonathan E. Child

It is certified that error appears in the above-identified patent and that said Letters Patent is hereby corrected as shown below:

Column 3, line 19, change "feedstocks" to --feedstock--.

Column 8, line 11, change "OR 81-P-40" to --CR 81-P-40--.

Column 8, line 10, change "Mobile" to --Mobil--.

Column 10, line 13, change formula from: "$Pt(NH_3)_4 2+$" to --$Pt(NH_3)_4^{2+}$--.

Signed and Sealed this

Twenty-fifth Day of November, 1986

*Attest:*

DONALD J. QUIGG

*Attesting Officer* *Commissioner of Patents and Trademarks*